United States Patent [19]

Zundel

[11] Patent Number: 4,790,371

[45] Date of Patent: Dec. 13, 1988

[54] TUBE-TYPE HEAT EXCHANGER

[76] Inventor: Daniel Zundel, 20, rue de la Herse, 68000 Colmar (Haut-Rhin), France

[21] Appl. No.: 515,069

[22] Filed: Jul. 19, 1983

[30] Foreign Application Priority Data

Feb. 24, 1983 [FR] France ..... 83 03202

[51] Int. Cl.[4] ..... F28F 9/22

[52] U.S. Cl. ..... 165/163

[58] Field of Search ..... 165/160, 163

[56] References Cited

U.S. PATENT DOCUMENTS

| | | | |
|---|---|---|---|
| 1,091,369 | 3/1914 | Mejani | 165/163 |
| 1,769,265 | 7/1930 | Labus | 165/161 |
| 1,915,352 | 6/1933 | Bottoms | 165/160 |
| 2,508,247 | 5/1950 | Giauque | 165/160 |
| 3,116,790 | 1/1964 | Walter | 165/163 |
| 3,228,463 | 1/1966 | Kagi | 165/163 |
| 3,335,790 | 8/1967 | Aranyi et al. | 165/163 |
| 3,496,997 | 2/1970 | Weber | 165/163 |
| 4,313,491 | 2/1982 | Molitor | 165/163 |
| 4,462,463 | 7/1984 | Gorham, Jr. | 165/163 |

FOREIGN PATENT DOCUMENTS

| | | | |
|---|---|---|---|
| 59448 | 1/1913 | Austria | 165/163 |

*Primary Examiner*—Abraham Hershkovitz
*Assistant Examiner*—John T. Kwon
*Attorney, Agent, or Firm*—Young & Thompson

[57] ABSTRACT

A tube-type heat exchanger comprises a plurality of tubes (1) all of which are of the same length, wound in the form of concentric cylindrical coils that touch each other, the pitch of the coils being different and the various coils being either wound in the same direction, or wound in alternately opposite directions. Each coil is comprised by one or more tubes bent to the same radius, the number of tubes in each coil increasing as the diameter of the coil.

4 Claims, 1 Drawing Sheet

TUBE-TYPE HEAT EXCHANGER

The present invention relates to thermal apparatus, particularly heat pumps, and has for its object the provision of a tube-type heat exchanger.

Existing heat exchangers, of the condenser or evaporator type, are generally constituted by a helical coil disposed in a heat exchange chamber, in which the helical coil transmits the heat or cold which it applies to the fluid undergoing a change of state, which surrounds it. However, in known chambers, the pressure drops in the primary and secondary circuits are substantial and the exchangers require large dimensions to permit good heat output, this large dimensioning increasing the cost of such exchangers.

It has been proposed to avoid these drawbacks by providing a heat exchanger constituted by the spiral winding of a sheet of contiguous tubes disposed in an annular chamber delimited by an internal tube comprising the winding core, and by an external tube surrounding the winding.

However, such an exchanger does not enjoy uniform flow rates and uniform pressure drops in the tubes comprising it, by virtue of the difference of length which necessarily exists, between the inner tubes and the outer tubes, whereby the thermal output is substantially affected.

The present invention has for its object to overcome these drawbacks.

Accordingly, it has as an object the provision of a tube-type heat exchanger, constituted essentially by tubes disposed in an annular chamber formed by a core and by an external envelope, characterized in that the tubes in the annular chamber all have the same length and are wound in the form of touching concentric helical cylinders, of different pitches, wound all in the same direction or in alternate directions about the core, these helical cylinders being constituted each by one or a plurality of tubes bent to the same radius, the number of tubes increasing as the diameter of the cylindrical helix.

Figure 1:
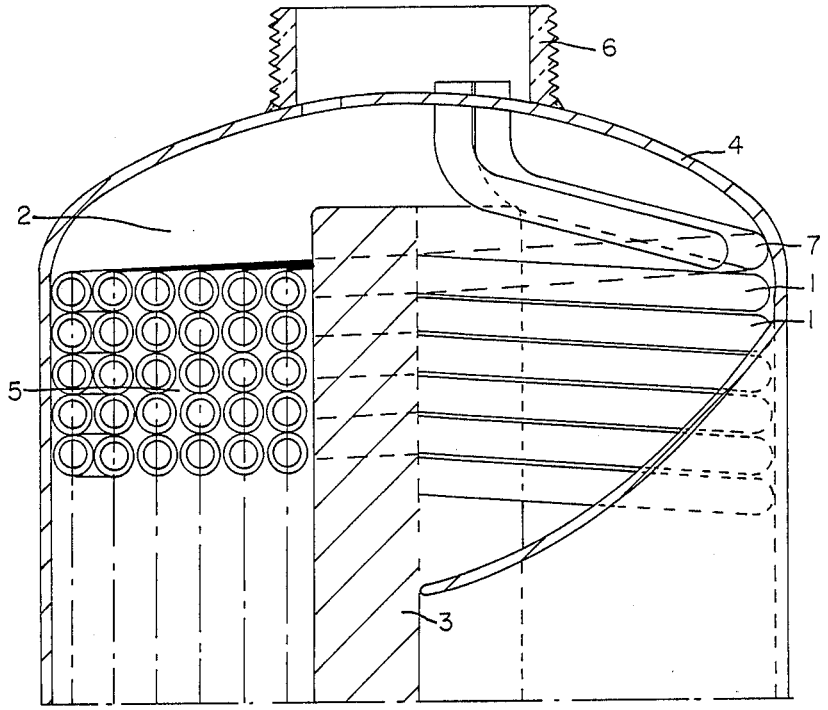
Figure 2:
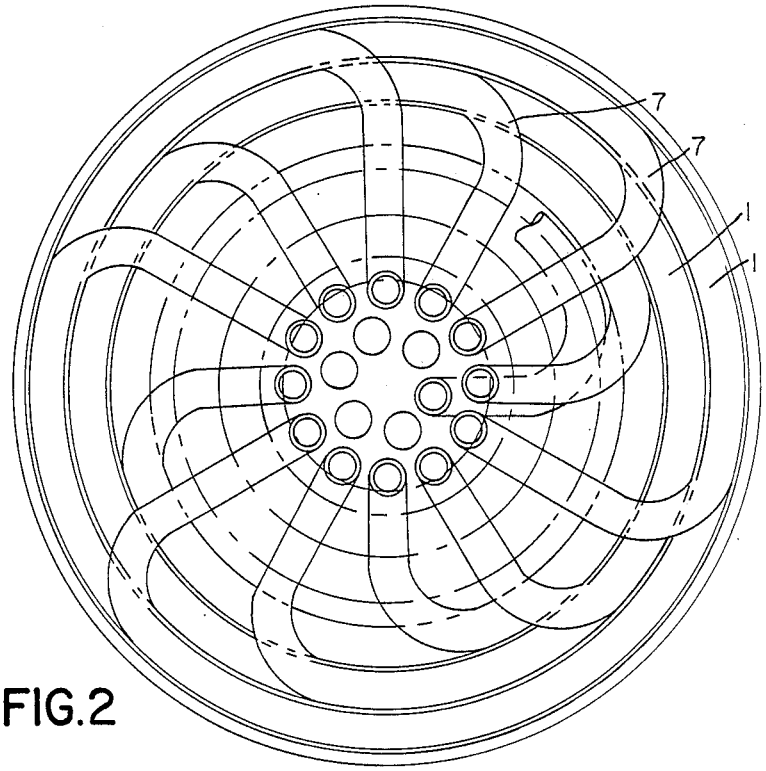

The invention will be better understood with reference to the following description, which relates to a preferred embodiment, given by way of non-limitating example and explained with reference to the accompanying schematic drawing, in which:

FIG. 1 is a view partially broken away and partially in cross section, of a heat exchanger according to the invention; and FIG. 2 is a plan view of the heat exchanger of FIG. 1.

According to the invention, and as is shown by way of example in FIGS. 1 and 2 of the accompanying drawing, the heat exchanger of the present invention is essentially constituted by tubes 1 disposed in an annular chamber 2 about a central core 3 and surrounded by an outer envelope 4. It is characterized in that the tubes 1 all have the same length and are wound about core 3 in the form of cylindrical helices that touch each other, which have different pitches, and are either wound all in the same direction or in alternately opposite directions. These helical cylinders are constituted each by one or several tubes 1, all the tubes 1 in a given cylindrical helix being bent to the same radius, and the number of the tubes 1 varying as the diameter of the cylindrical helix, that is, increasing with said diameter.

The coils of the cylindrical helices thus formed touch each other or substantially touch each other, so as to leave only minimum space for the passage of a fluid to undergo change of state during heating or cooling, while at the same time offering maximum heat exchange surface.

The tubes 1 are preferably numerous and have a diameter and a length which are relatively small, thereby providing, even at low flow rates, relatively high flow speeds resulting in turbulent flow, and thus good heat exchange. The movement of liquid in the tubes 1 of small diameter permits an increase in the heat exchange surface for a given flow, whereby the thermal output of the exchanger is improved relative to an exchanger comprising a small number of large tubes. Moreover, the feature of making tubes 1 relatively short permits compensating the increase of the pressure drops resulting from turbulent flow due to their small diameter.

The provision of tubes 1 having all the same length permits moreover uniform flow and uniform pressure drop in said tubes.

The manner of constructing the invention thus ensures identical temperature change of the liquid for all the tubes, which is very important from a thermodynamic point of view.

By virtue of the concentric arrangement and the intercontact of the cylindrical helices of tubes 1 and the fact that the windings of each cylindrical helix are in contact with each other, the free space 5 between the tubes 1 in the annular chamber is reduced to the minimum, which is sufficient to absorb relatively small mass flows of the fluid while changing state in the evaporator or the condenser, these flows being much less than those of the liquid circulating in the tubes 1 and with which the heat exchange is effected.

Moreover, when using the exchanger according to the invention as an evaporator, in its preferred vertical position, the boiling liquid is in the lower part and the vapors are removed from the upper part. In refrigeration circuits, the fluid subjected to change of state ordinarily entrains a small quantity of lubricating oil from the compressor, which accordingly must be continuously returned to the latter. However, in known evaporators, the oil-refrigerant mixture is subjected to distillation as a result of which the non-volatile oil tends to remain and to accumulate in the lower part of the evaporator.

The invention permits avoiding this accumulation thanks to the reduction of available volume in the annular chamber 2, which has the effect of a forced vertical draft of the oil in the form of droplets or mist entrained in vapors, which travel at relatively high velocities.

According to another characteristic of the invention, the tubes 1 preferably have a diameter less than six times their wall thickness, and are so constituted as to have neither dead space nor a change in diameter, in their extent in contact with the fluid undergoing change of state, their ends communicating, by means of short elbows 7 of an internal radius equal to 1.25 diameters, with the outside of the annular chamber 2 in the fluid outlet tube 6, in a direction parallel to this tube and to the direction of liquid flow at the inlet and outlet of the exchanger.

Such an arrangement permits avoiding, in case of accidental freezing of the liquid in the tubes 1, the destruction of these latter, the tubes 1 resisting the pressure and the ribbon of frozen liquid expanding axially.

The exchanger according to the invention is more particularly adapted to be used in refrigeration machines in the form of an evaporator or condenser, in which heat exchange takes place between a liquid circulating in the tubes 1 and a fluid undergoing change of state flowing through annular space 2.

Of course, the invention is not limited to the embodiment described and shown in the accompanying drawing. Modifications are possible, particularly as to the construction of the various elements, or by substitution of technical equivalents, without thereby departing from the scope of protection of the invention.

What is claimed is:

1. A tube-type heat exchanger, comprising a plurality of tubes (1) disposed in an annular chamber (2) having a central core (3) and an external envelope (4), the tubes being all of the same length and being disposed in the form of touching concentric annular cylindrical spirals of different pitch, at least some of said. cylindrical spirals being constituted each by a plurality of said tubes all of which are bent to the same radius, the number of said tubes in a said helical spiral increasing as the diameter of the spiral.

2. A heat exchanger as claimed in claim 1, in which the tubes are large in number and small in diameter length thereby to promote turbulent flow within the tubes.

3. A heat exchanger as claimed in claim 1, in which the tubes have a diameter less than six times their wall thickness and are so shaped as to have neither dead spaces nor changes in internal diameter where exposed to the fluid, the ends of the tubes terminating in short elbows of a radius equal to about 1.25 diameters, said ends extending outside the external envelope in a direction parallel to the axis of the coils.

4. A heat exchanger as claimed in claim 1, in which the tubes are all of the same diameter.

* * * * *